US007810254B2

(12) United States Patent
Wu

(10) Patent No.: US 7,810,254 B2
(45) Date of Patent: Oct. 12, 2010

(54) SHOCK ATTENUATION SYSTEM FOR THE INSOLES OF SHOES

(76) Inventor: Yun-foo Wu, Flat G, 4/F., Hong Shun Court, Sun Hing Garden, Tai Po, NT, Hong Kong (CN)

( * ) Notice: Subject to any disclaimer, the term of this patent is extended or adjusted under 35 U.S.C. 154(b) by 1113 days.

(21) Appl. No.: 10/584,663

(22) PCT Filed: Dec. 29, 2004

(86) PCT No.: PCT/CN2004/001559

§ 371 (c)(1),
(2), (4) Date: Jun. 26, 2006

(87) PCT Pub. No.: WO2005/072549

PCT Pub. Date: Aug. 11, 2005

(65) Prior Publication Data

US 2007/0209231 A1 Sep. 13, 2007

(30) Foreign Application Priority Data

Dec. 29, 2003 (CN) ..... 2003 1 0112998

(51) Int. Cl.
*A43B 13/20* (2006.01)
*A43B 13/38* (2006.01)

(52) U.S. Cl. ..... 36/29; 36/43

(58) Field of Classification Search ..... 36/29, 36/35 B, 102, 103, 43, 44, 93, 27, 150, 153, 36/155–157
See application file for complete search history.

(56) References Cited

U.S. PATENT DOCUMENTS

| | | | | | |
|---|---|---|---|---|---|
| 4,446,634 | A * | 5/1984 | Johnson et al. | ..... | 36/29 |
| 4,633,597 | A * | 1/1987 | Shiang | ..... | 36/43 |
| 4,995,173 | A * | 2/1991 | Spier | ..... | 36/29 |
| 5,813,142 | A * | 9/1998 | Demon | ..... | 36/29 |
| 5,846,063 | A * | 12/1998 | Lakic | ..... | 417/440 |
| 6,892,477 | B2 * | 5/2005 | Potter et al. | ..... | 36/29 |

FOREIGN PATENT DOCUMENTS

| | | |
|---|---|---|
| CN | 1223102 A | 7/1999 |
| CN | 2468326 Y | 1/2002 |
| FR | 2746701 | 7/1997 |

* cited by examiner

*Primary Examiner*—Jila M Mohandesi
*Assistant Examiner*—Melissa L Lalli
(74) *Attorney, Agent, or Firm*—Allen, Dyer, Doppelt, Milbrath & Gilchrist, P.A. Attorneys at Law

(57) ABSTRACT

An adjustable shock attenuation system for an insole of a shoe includes an insole body and a pressure controller. The pressure controller uses two pressure controlling modes, and can be adjusted to select between the alternate pressure controlling modes using a rotatable shaft extending from the sole of the shoe.

4 Claims, 3 Drawing Sheets

SHOCK ATTENUATION SYSTEM FOR THE INSOLES OF SHOES

TECHNICAL FIELD

The present invention relates to elastic insoles for shoes, and more particularly, to a shock attenuation system for the elastic insoles of shoes.

BACKGROUND ART

In conventional shock attenuation systems for shoes, some shoes have springs set in the hollow interior of the insole, while some shoes have a circulating flow pressure controlling mechanism or a bi-directional flow pressure controlling mechanism. However, different people may have different body weights, and each person may undertake different activities, such as an ordinary walk or a strenuous exercise etc., Accordingly, there is a demand for a shock attenuation system, which is comfortable on the human body, and can be variable for different occasions and to suit or different people. Unfortunately, in prior art designs, the shock attenuation and damping-effect capability of the elastic insole is not adjustable, and therefore does not satisfy the user's requirements.

SUMMARY OF INVENTION

The present invention relates to a shock attenuation system for elastic insoles of shoes with adjustable elastic force, which overcome the shortcomings of the prior art designs, in which the shock attenuation and damping effect is not adjustable.

The shock attenuation method of elastic insole of shoes according to the present invention is as follows: a shock attenuation system for an insole of a shoe comprising an insole body, and a pressure controller located at a side of said insole body.

The pressure controller includes a first multi-pipe circulating flow pressure controller and a second single-pipe bi-directional flow pressure controller.

The pressure controller also includes an adjusting device installed between the first controller and the second controller for controlling the operation of the first and second pressure controllers.

The adjusting device comprises: a rotatable shaft; a rotating knob on a first exterior end of said rotatable shaft; disc-shaped adjusting heads mounted on said rotatable shaft proximate the middle thereof; and an adjustable tip at a second interior end of said rotatable shaft. In use, rotation of the rotating knob in one direction rotates the rotatable shaft upwards, thereby closing said first flow pressure controller using the disc-shaped adjusting heads while opening the second flow pressure controller using the adjustable tip.

Also, in use, rotation of the rotating knob in an opposite direction rotates the rotatable shaft downwards, thereby opening the first flow pressure controller while closing the second flow pressure controller.

Preferably, the first controller includes a first ball valve at an entry to flow passage, and a vane valve at an exit of the flow passage;

Preferably, the second controller includes a second ball valve at an access to a flow passage, and the second ball valve is equipped with a spring for pushing the second ball valve into the flow passage;

Preferably, the first ball valve includes at least one first ball, and the second ball valve includes a second ball. Preferably, the disc-shaped adjusting laterally displace the at least one first ball to close the first ball valve; and the adjusting tip presses against the second ball of the second ball valve to displace the second ball longitudinally to open the second ball valve;

The number of the disc-shaped adjusting heads may be set corresponding to the number of the first balls to be controlled.

An advantage of the present invention is that, the pressure controller has at least two kinds of pressure control modes that may be included, for example, a multi-pipe circulating flow pressure controller and a single-pipe bi-directional flow pressure controller. Since the shock attenuation and damping effect produced by the two flow pressure controllers are different, the shock attenuation and damping capability of the shoes may be adjusted by choosing one of the pressure control modes in accordance with the specific occasion or the specific person, to satisfy the requirements of the user's foot depending on the situation. Disc-shaped adjusting heads are mounted, like sleeves, on the middle part of the rotatable shaft, whereby moving the disc-shaped adjusting heads, laterally displaces the balls of the first ball valve. This kind of oblique periphery design for the disc-shaped adjusting heads can reduce the wearing of the contacting surfaces between the balls and the disc-shaped adjusting heads. In addition, as the area of the bottom of the disc-shaped adjusting heads are rather large, they can be fixed in the shoes more effectively and the utility of the present invention is improved. A first spring is set below the lower disc-shaped adjusting head, and a second spring is set in the ball valve of the single-pipe bi-directional flow pressure controller, which pushes downwards against the ball to help the positioning of the pressure controller. In addition, the springs help to reduce the displacement for controlling, namely to reduce the lifting amplitude of the rotatable shaft when adjusting the shock attenuation effect, and further improve the practicability and reliability of the present invention. In all, the present invention can adjust shock attenuation and damping effect, is practical and reliable, and can satisfy the human requirements to the utmost extent.

DETAILED DESCRIPTION OF THE PREFERRED EMBODIMENTS

Hereinafter the present invention will be described in details with reference to the accompanying drawings and embodiments.

Figure 1:
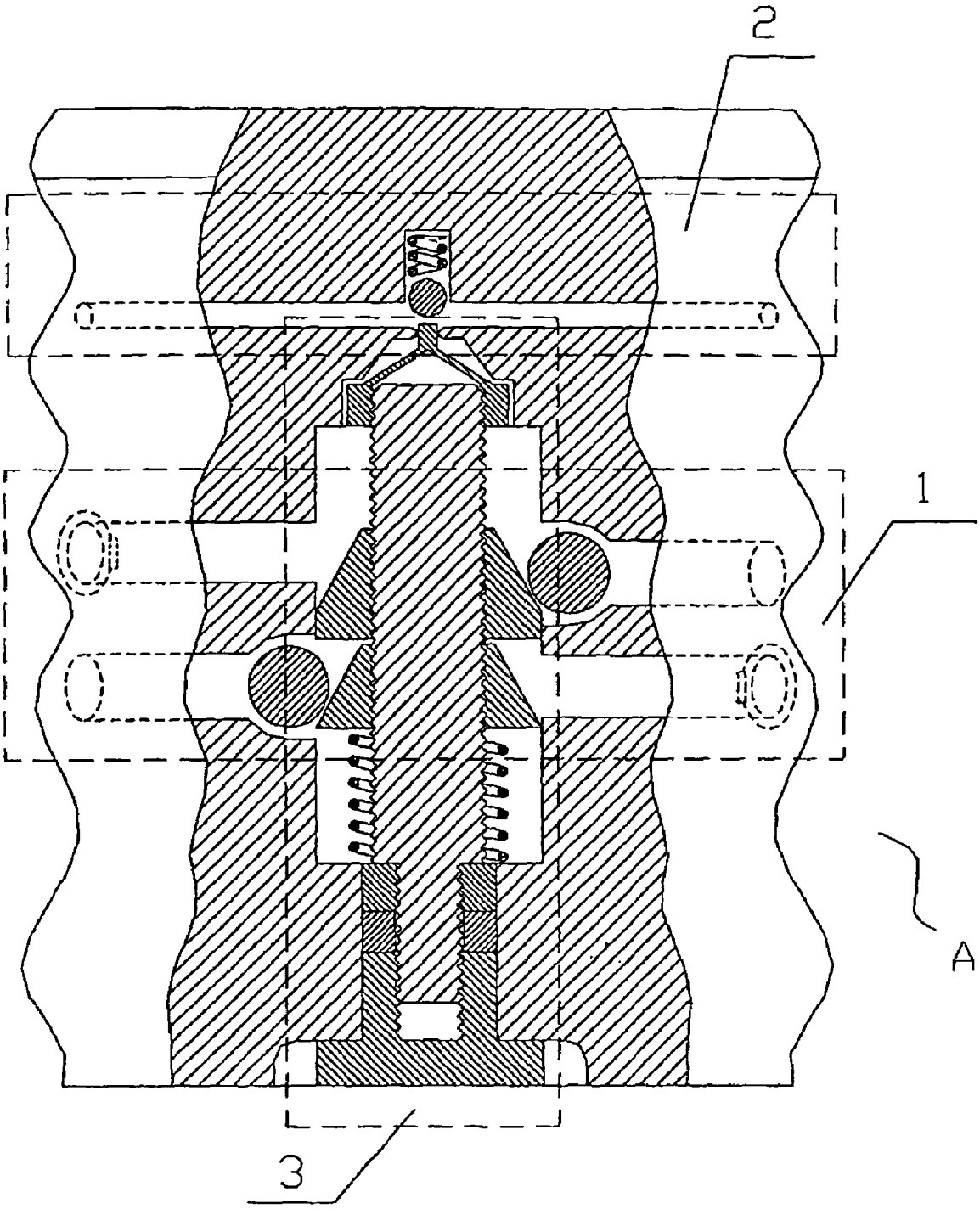
FIG. 1 is a schematic view of the whole assembly of the pressure controller of the present invention.
Figure 2:
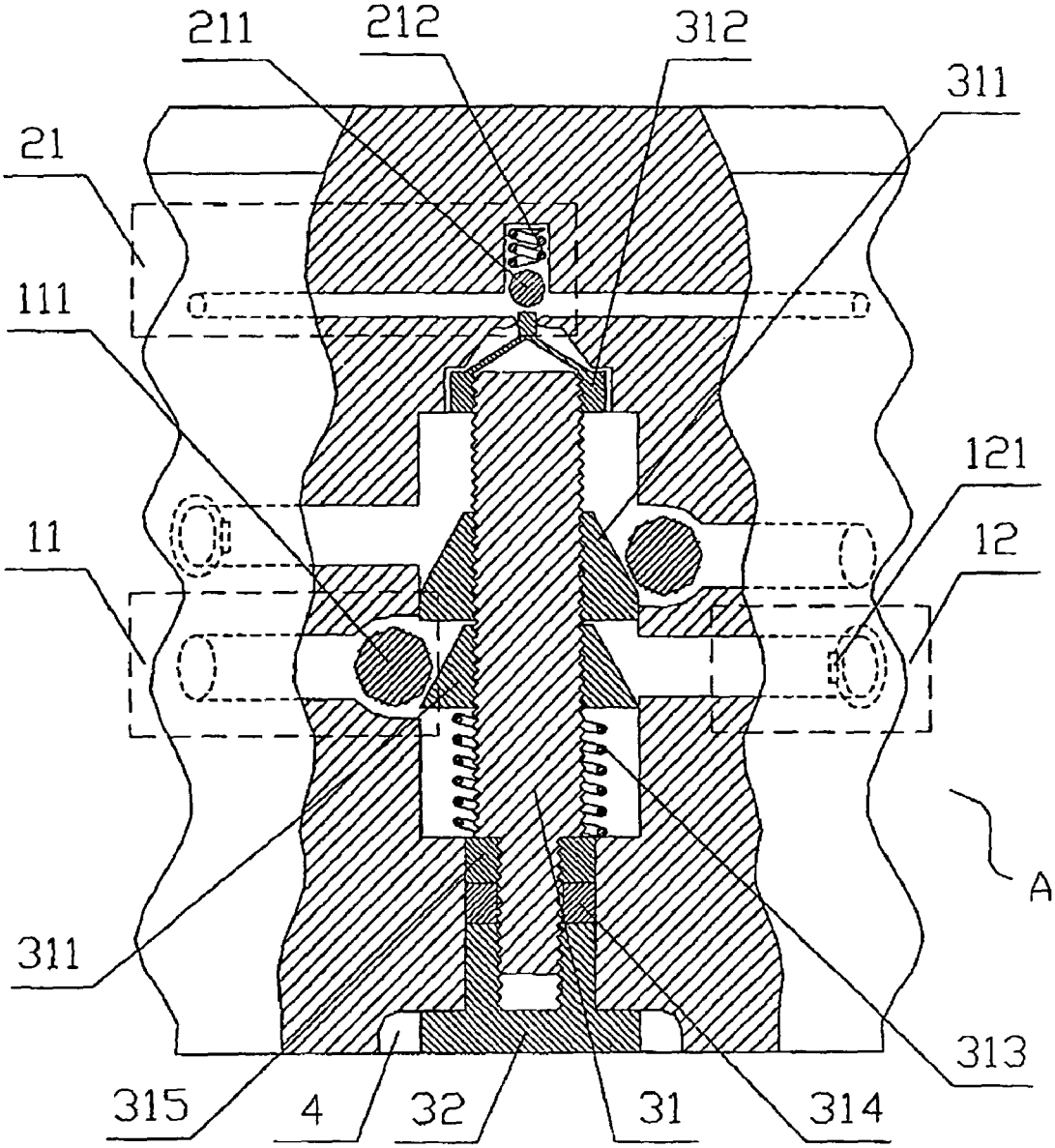
FIG. 2 is a schematic view indicating parts of the pressure controller of the present invention, wherein the middle part of the figure is a partial sectional view.
Figure 3:
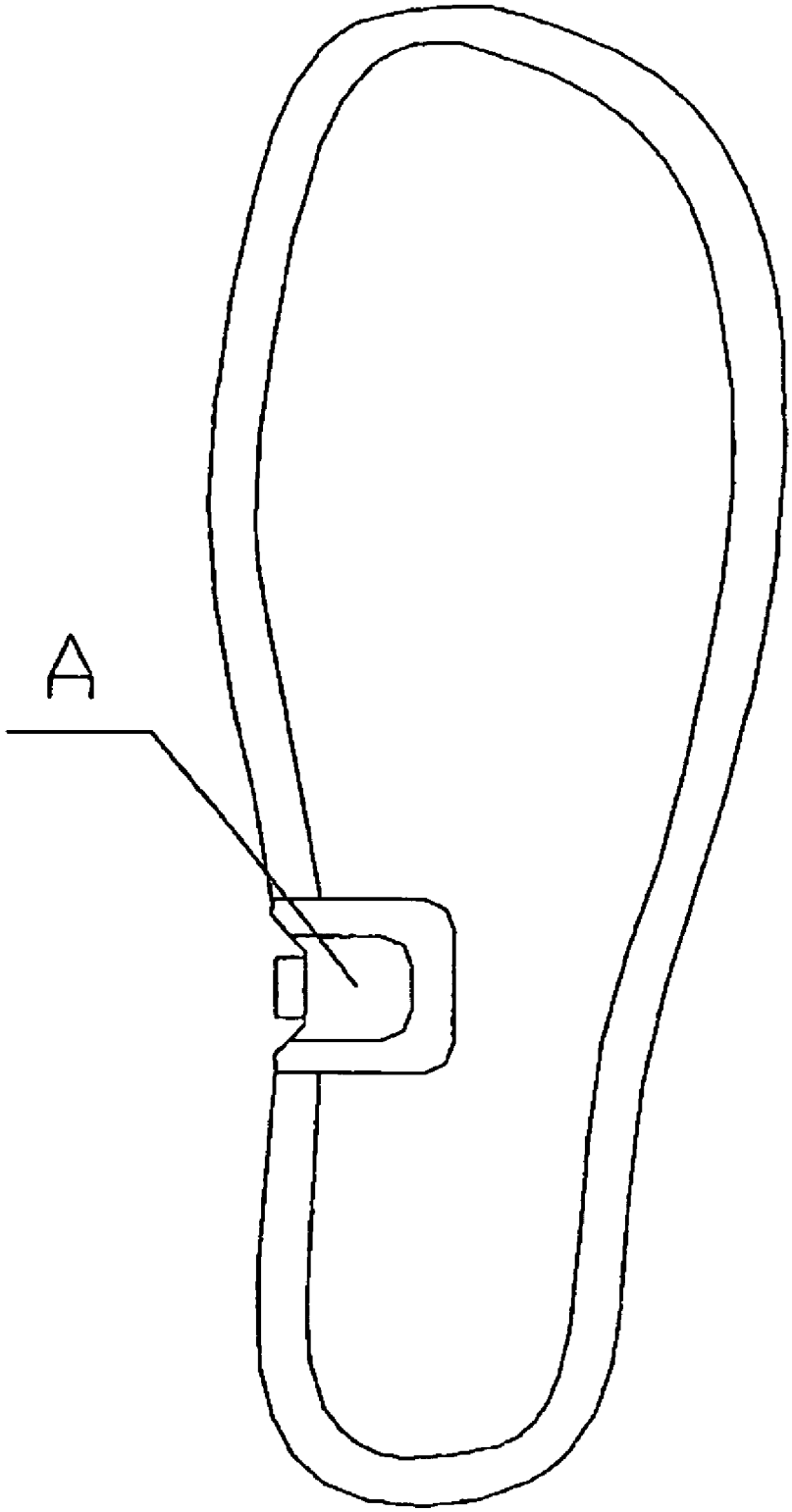
FIG. 3 is a schematic view of the appearance of the bottom of the insole body of the present invention.

According to FIGS. 1, 2 and 3, the present invention includes an insole body, which has a pressure controller A located at its side. In the embodiment shown in FIG. 1 and FIG. 2, the two pressure controllers include a multi-pipe circulating flow pressure controller 1 and a single-pipe bi-directional flow pressure controller 2. An adjusting device 3, which controls the startup of either one of the two pressure controllers 1 and 2 according to the user's choice, is further installed between the two pressure controllers 1 and 2.

The multi-pipe circulating flow pressure controller 1 includes a ball valve 11 as the entry of the flow passage, and a vane valve 12 as the exit of the flow passage. As shown in FIG. 2, a hinge 121 is set in the vane valve 12. The single-pipe bi-directional flow pressure controller 2 includes a ball valve 21 as the access of the flow passage. The adjusting device 3 is used to control the opening and closing of the control units of the two pressure controllers 1 and 2.

As shown in FIG. 2, the adjusting device 3 includes a rotatable shaft 31, and a rotating knob 32 connected to the exterior bottom end of rotatable shaft 31. The rotating knob 32 is fastened at the bottom end of the rotatable shaft 31 extending outwardly with respect to the ball valve 11, and the rotating knob 32 is engaged with the rotation shaft 31 by screw threads. A concave recess 4 is set in the insole for receiving the rotating knob 32. A leak resistant ring seal 314 is set between the rotating knob 32 and the rotatable shaft 31, and a cage nut 315 is set on the leak resistant ring seal 314. Disc-shaped adjusting heads 311 are mounted, likes sleeves, on the middle part of the rotatable shaft 31, whereby movement of the adjusting heads 311, laterally displaces the balls 111 of the ball valve 11. A spring 313 is set below the lower disc-shaped adjusting head 311. An adjustable tip 312 is set on the interior top of the rotatable shaft 31 for pressing against a ball 211 of the ball valve 21 and to make the ball 211 displace along the longitudinal axis of the rotatable shaft 31. A spring 212 is set within the ball valve 21 so as to downwardly push against the ball 211.

In the present invention, the adjusting device 3 controls the opening and closing of the ball valve 11 of the multi-pipe circulating flow pressure controller 1 and the ball valve 21 of the single-pipe bi-directional flow pressure controller 2 alternately by rotation thereof. As shown in FIG. 1 and FIG. 2, the rotatable shaft 31 is moved upwards by adjusting the rotating knob 32. As the rotatable shaft 31 is moved upwards, the balls 111 are moved outwardly by the adjusting heads 311 until the ball valve 11 is closed. In the mean time, in the single-pipe bi-directional flow pressure controller 2, the ball 211 is pushed away from the flow passage of the ball valve 21 by the adjustable tip 312, thereby, the single-pipe bi-directional flow pressure controller 2 is opened and the multi-pipe circulating flow pressure controller 1 is closed. Alternatively, as shown in FIG. 1 and FIG. 2, the rotatable shaft 31 can also be is moved downwards by the rotating knob 32. Accordingly, in the single-pipe bi-directional flow pressure controller 2, the ball 211 is moved downwards till it blocks the flow passage of the ball valve 21. In the mean time, in the multi-pipe circulating flow pressure controller 1, the ball 111 returns toward the center of the rotatable shaft, thereby, the flow passage of the ball valve 11 is opened. As a result, the multi-pipe circulating flow pressure controller 1 is opened and the single-pipe bi-directional flow pressure controller 2 is closed. In such a way, the ball valves 11 and 21 are opened and closed alternately by adjusting the rotating knob 32. It could be seen from the above that the adjusting device 3 controls the opening or closing of the control valves of the two kinds of pressure controlling modes by a screw element. In such a way, the present invention introduces a multi-pipe circulating flow pressure controlling mode for the multi-pipe circulating flow pressure controller 1 and a single-pipe bi-directional flow pressure controlling mode for the single-pipe bi-directional flow pressure controller 2, and one of said pressure controlling modes is selected to be opened or closed alternately by the adjusting device 3. The multi-pipe circulating flow pressure controller 1 or the single-pipe bi-directional flow pressure controller 2 of the present invention could be a pressure controller for liquid or gas flow.

In practical use, the number of the disc-shaped adjusting heads 311 may be set corresponding to the number of the ball valves to be controlled.

In this embodiment the structure and working process of the two pressure controlling modes adopted in the pressure controller A are described, namely the multi-pipe circulating flow pressure controlling mode and the single-pipe bi-directional flow pressure controlling mode. Similarly, the pressure controller A could adopt two different kinds or more than two kinds of pressure controlling modes as well. As for the principle and structure, they are the same as or similar to the above description, which could be implemented by a technical person in this field without creative work. Therefore, it is not necessary to describe in details here.

The invention claimed is:

1. A shock attenuation system for an insole of a shoe comprising:

an insole body, a pressure controller located at a side of said insole body, wherein said pressure controller includes a first multi-pipe circulating flow pressure controller;

a second single-pipe bi-directional flow pressure controller; and an adjusting device extending between said first flow pressure controller and said second flow pressure controller, for controlling the operation of said first and second flow pressure controllers, wherein said adjusting device comprises:

a rotatable shaft;

a rotating knob on a first exterior end of said rotatable shaft;

disc-shaped adjusting heads mounted on said rotatable shaft proximate a middle thereof;

an adjustable tip at a second interior end of said rotatable shaft whereby, in use, rotation of said rotating knob in one direction rotates the rotatable shaft upwards, thereby closing said first flow pressure controller using said disc-shaped adjusting heads while opening said second flow pressure controller using said adjustable tip; and whereby, in use, rotation of said rotating knob in an opposite direction rotates said rotatable shaft downwards, thereby opening said first flow pressure controller while closing said second flow pressure controller.

2. A shock attenuation system as claimed in claim 1, wherein said first flow pressure controller includes a first ball valve at an entry to a flow passage, and a vane valve at an exit of the flow passage; and wherein said second flow pressure controller includes a second ball valve at an access to a flow passage, and wherein said second ball valve is equipped with a spring for pushing the second ball valve into the flow passage.

3. A shock attenuation system as claimed in claim 2, wherein said first ball valve includes at least one first ball, and said second ball valve includes a second ball; wherein said disc shaped adjusting heads laterally displace said at least one first ball to close the first ball valve; and wherein the adjustable tip presses against the second ball to displace the second ball longitudinally to open the second ball valve.

4. A shock attenuation system as claimed in claim 3, wherein a number of the disc-shaped adjusting heads corresponds to a number of first balls.

* * * * *